United States Patent [19]

Wong

[11] Patent Number: 5,029,732

[45] Date of Patent: Jul. 9, 1991

[54] TOY WATER GUNS

[75] Inventor: Siu L. E. Wong, Kowloon, Hong Kong

[73] Assignee: Blue Box Toy Factory Limited, Kowloon, Hong Kong

[21] Appl. No.: 380,356

[22] Filed: Jul. 17, 1989

[51] Int. Cl.[5] ..... F41B 9/00

[52] U.S. Cl. ..... 222/79; 222/379

[58] Field of Search ..... 222/78, 79, 379, 375; 137/533.21, 533.31; 417/552

[56] References Cited

U.S. PATENT DOCUMENTS

| | | | |
|---|---|---|---|
| 1,801,383 | 4/1931 | Winsor | 137/533.21 |
| 2,527,614 | 10/1950 | Arpin | 222/79 |
| 4,062,378 | 12/1977 | Bender | 137/535 |
| 4,630,757 | 12/1986 | Yano | 222/79 |

FOREIGN PATENT DOCUMENTS

| | | |
|---|---|---|
| 2098078A | 11/1982 | United Kingdom . |
| 2145340A | 3/1985 | United Kingdom . |
| 2185527A | 7/1987 | United Kingdom . |

*Primary Examiner*—Michael S. Huppert
*Assistant Examiner*—Anthoula Pomrening
*Attorney, Agent, or Firm*—Pollock, Vande Sande & Priddy

[57] ABSTRACT

An inlet valve for a toy water gun comprising an outer hollow sleeve molded from sythetic plastics material having an upstream end and a downstream end, water from a reservoir being arranged to be in communication with the downstream end, an annular seating at the upstream end, and a central plunger molded from synthetic plastics material, the plunger comprising a head having an annular sealing surface capable of engaging the annular seating and sealing thereagainst, an integral shaft slidably received within the hollow sleeve, a stop at the end remote from the head which together with the head retains the shaft in the hollow sleeve, and a passage between the shaft and the hollow sleeve to allow the passage of water past the plunger when the head is not engaged on the seating.

7 Claims, 3 Drawing Sheets

TOY WATER GUNS

This invention relates to toy water guns.

BACKGROUND TO THE INVENTION

Numerous forms of toy water guns, or water pistols as they are sometimes called, are known. Generally they comprise a reservoir, some form of pump for supplying a discrete amount of water under pressure from the reservoir to an outlet nozzle where it is emitted as a high speed squirt of water. Sometimes the pump is directly manually operated by a trigger and in other cases the pump can be electrically operated with the trigger acting on an electrical switch.

Generally toy water guns of this type comprise a pump including a piston movable along a cylinder and inlet and outlet valves for pumping water from the reservoir and delivering it under pressure to the nozzle. In such pumps the inlet and outlet valves have frequently been of the type where a small metal ball is pressed by a metal spring against a seating aligned with a bore for the passage of water, such that the pressure of water on the downstream side of the ball can lift the ball from its seating to allow water to pass the ball but once that pressure is removed then the spring will press the ball back against its seating and prevent the passage of water in the return direction.

Such valves are well known but do have certain disadvantages. In particular the springs need to be of a high quality to ensure consistency of action and therefore only when the more expensive materials and higher quality springs and the like are used can one expect reasonable reliability. Toy water guns by their very nature are designed to be cheap items however and there is therefore a clear conflict between the aims of producing a cheap toy water gun and a gun of good reliability in use.

It is therefore an object of the present invention to provide a valve which can be used particularly for the inlet valve for the pump, which can be relatively cheaply produced but can be of good reliability.

BRIEF SUMMARY OF THE INVENTION

Therefore according to one aspect of the invention, in a toy water gun of the type described there is provided an inlet valve comprising:

- an outer hollow sleeve molded from synthetic plastics material having an upstream end and a downstream end,
- water from the reservoir being arranged to be in communication with the upstream end,
- an annular seating at the downstream end, and
- a central plunger molded from synthetic plastics material, the plunger comprising a head having an annular sealing surface capable of engaging the said annular seating and sealing thereagainst, an integral shaft slidably received within the hollow sleeve, a stop at the end remote from the head which together with the head retains the shaft in the hollow sleeve, and passage means between the shaft and the hollow sleeve to allow the passage of water past the plunger when the head is not engaged on the seating.

The invention is particularly applicable to toy water guns where the piston in the pump is hollow and carries the inlet valve, water from the reservoir passing along the hollow interior of the piston and through the valve into the cylinder as the piston is withdrawn along the cylinder.

The outlet valve can if desired be constructed in a similar way to the inlet valve but this is usually not necessary. Instead it is usually quite satisfactory for the outlet valve to be of the type comprising a spring loaded ball which bears against a seating since the reliability of sealing for the outlet valve is not as critical as the reliability of sealing for the inlet valve which has to resist the high water pressure as the water is forced through the nozzle.

In one preferred embodiment of the invention the annular seating on the downstream end of the hollow sleeve is of hollow frusto-conical shape, whilst the annular sealing surface on the head is of corresponding frusto-conical shape, the sealing surface on the head of the plunger seating against the annular seating when the valve is in the closed position. It is also preferable that the end of the head be of an open conical shape so that the pressure of water, when the pump is actuated, has the effect of pressing the plunger against the hollow sleeve so that the annular seating surface engages tightly with the annular seating. Also the pressure tends to ensure good sealing since the head is forced against the seating by the pressure and so the resilient plastics material of the head of the plunger will be slightly deformed if necessary into a very good seal against the seating.

According to one preferred embodiment of the invention, the toy water gun comprises a first hollow handle portion including an integral first handle, that said first portion containing the reservoir and supporting the piston of the pump, and a second hollow portion including an integral second handle and carrying the cylinder of the pump and into which the piston projects, the second handle portion supporting the nozzle, the first and second portions being telescopically mounted relative one another between advanced and retracted positions and movement of the portions between those said positions reciprocating the piston along the cylinder and the resulting pumping action ejecting squirts of water from the nozzle.

BRIEF DESCRIPTION OF THE DRAWINGS

The invention will now be described, by way of example, with reference to the accompanying drawings, in which.

DESCRIPTION OF THE PREFERRED EMBODIMENT

Figure 1:
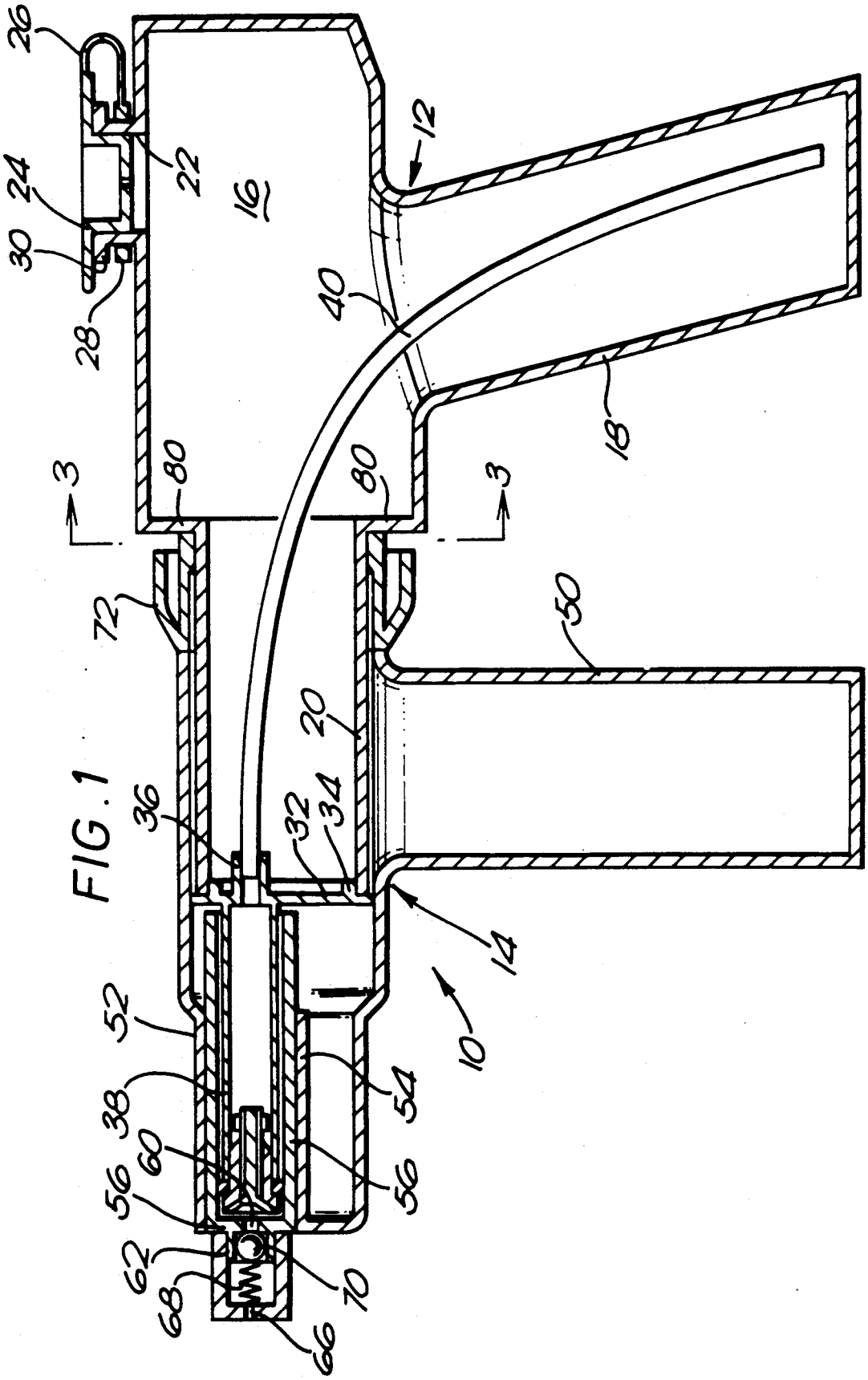
FIG. 1 is an upright section through a toy water gun according to the invention.

The toy water gun 10 shown in the drawings includes a rear reservoir and piston unit 12 and a front cylinder and nozzle unit 14. As will be described the units 12 and 14 can be moved in and out relative one and other between the positions shown in FIGS. 1 and 2 to provide a pumping action to deliver a squirt of water as is conventional with toy water guns.

The unit 12 includes a hollow rear portion 16 with an integral downwardly extending handle 18 by means of which the user can grasp that unit 12 with one hand.

Integrally formed and extending forward from the rear portion 16 is a barrel 20. The portion 16 is hollow and forms a water reservoir. At the top of the portion 16 is an opening 22 normally closed with a resilient cap 24. When the cap 24 is removed from the opening 22 water can be filled into the rear portion 16. The cap 24 includes an integrally formed hinge 26 and a ring 28 which surrounds the opening 22 and is retained in place bY means of an outwardly directed flange 30 at the top of the opening 22.

The front of the barrel 20 is closed by means of a circular plate 32 of diameter slightly larger that the diameter of the barrel 20. The plate 32 includes an integral rearwardly extending circular flange 34 fitting tightly within the end of the barrel and enabling the plate 32 to be permanently joined to the end of the barrel 20. Additionally the plate 32 includes a rearwardly extending tube 36 and an integral forwardly extending sleeve 38. The latter forms the piston of the pump as will be described in due course. The tube 36 opens into the interior of the sleeve 38 and carries one end of a length of plastics tubing 40. The tubing 40 extends down into the lowermost portion of the handle 18 so as to conduct water from the rear portion 16 to the interior of the sleeve 38.

The unit 14 is also hollow and includes an integral downwardly extending handle 50 and a forwardly projecting barrel 52. Within that barrel 52 is an integrally formed cylinder 54 and fixed within that cylinder 54 is a pump cylinder 56 which acts as the cylinder in association with the sleeve 38 which acts as the piston of the pump as will be described. The cylinder 56 in turn is closed at the forward end by means of an integral inwardly projecting plate 58 through which is a small bore 60. The plate has an integral forwardly projecting tube 62 in alignment with the bore 60.

Over the end of the plate 58 is a hollow cap 64. The latter has an outlet nozzle 66 at its end through which a squirt of water can be ejected and fits over and is secured to the tube 62. Within the cap is positioned a small metal coil spring 68 which resiliently presses a metal ball 70 against the end of the bore 60.

Figure 2:
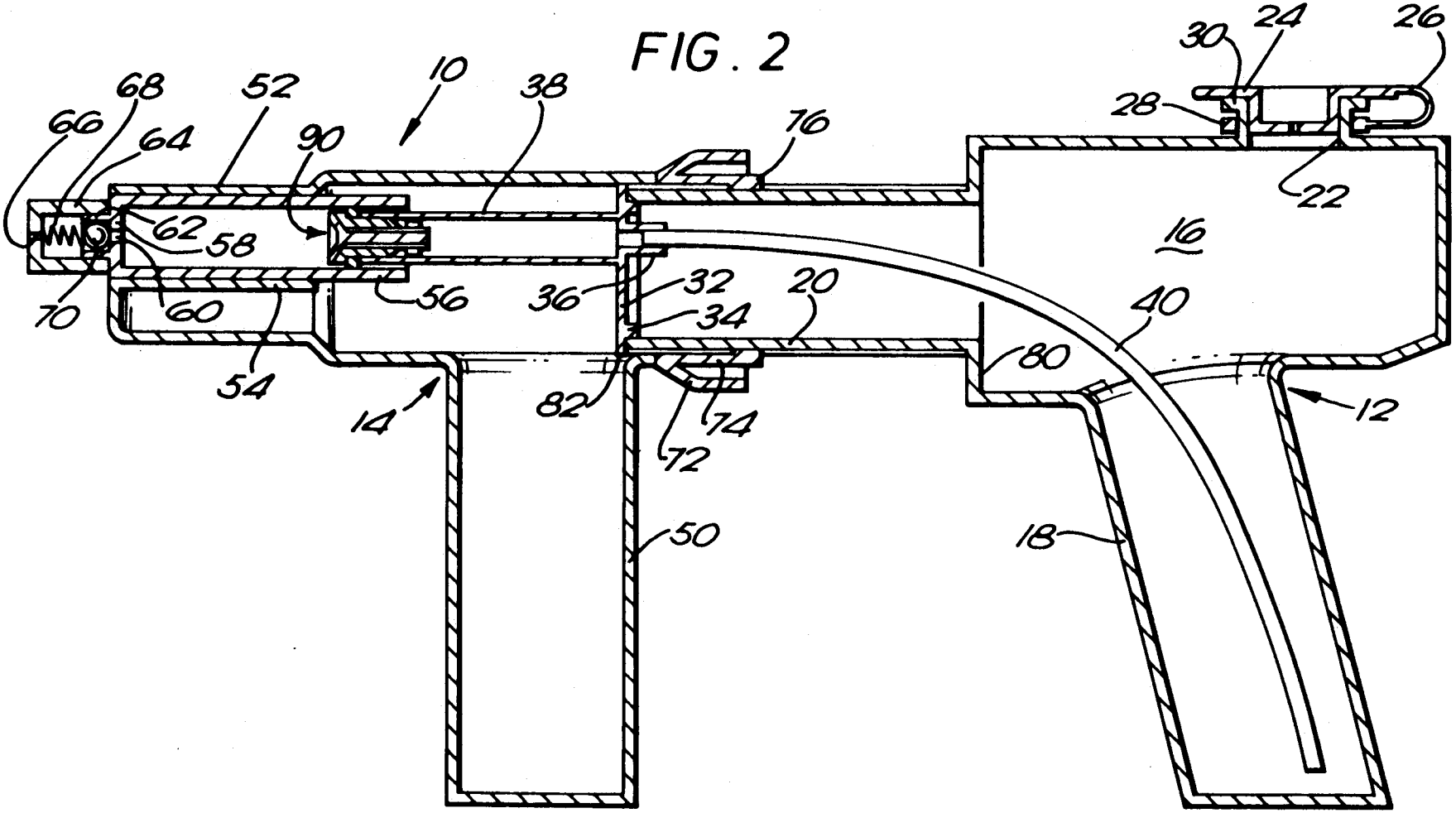
FIG. 2 is a section similar to FIG. 1 showing the parts of the gun moved to a different position.
Figure 3:
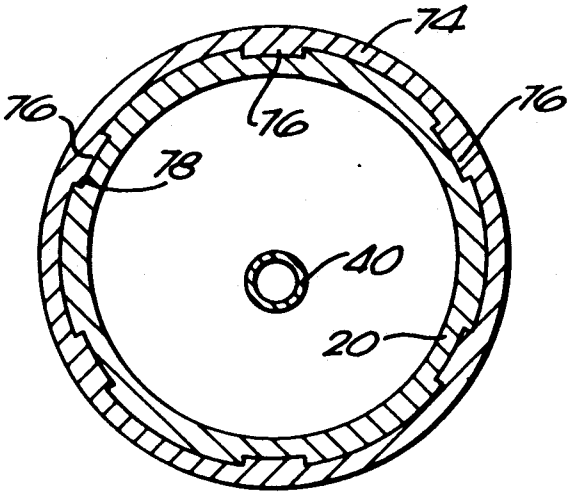
FIG. 3 is an enlarged cross section taken on the line 3—3 of FIG. 1.

The rear end of the unit 14 is open and receives the barrel 20. To that open rear is joined a circular flange unit 72. This includes a sleeve 74 having at its rear end a number of enlarged guides 76 as best seen in FIG. 3. The outside of the barrel 20 is formed with a number splines 78 and the enlarged guides 76 slide and fit in those splines. In this way the barrel 20 and sleeve 74 can slide inwardly and outwardly relative one and other to allow the gun to move between the positions shown in FIGS. 1 and 2 but relative rotation about the sliding axis is prevented.

In the position shown in FIG. 1 the enlarged guides 76 engage the rear of the splines and they abut a flange portion 80 of the unit 12. As previously mentioned the diameter of the plate 32 is somewhat larger than that of the outer diameter of the barrel 20 and so when the units 12 and 14 are therefore moved any further beyond the position shown in FIG. 2 the outside rim 82 of the plate 32 will engage the end of the circular flange unit 72 and prevent further movement so preventing the user from withdrawing the unit 12 totally from the unit 14. In that connection, it should be noted that when the unit is first assembled during manufacture, the barrel 20 is inserted into the unit 14 after having the circular flange unit 72 first placed in position and then the circular flange unit 72 is joined to the unit 14 by for example ultrasonic welding to permanently fix the units 12 and 14 together.

Figure 4:
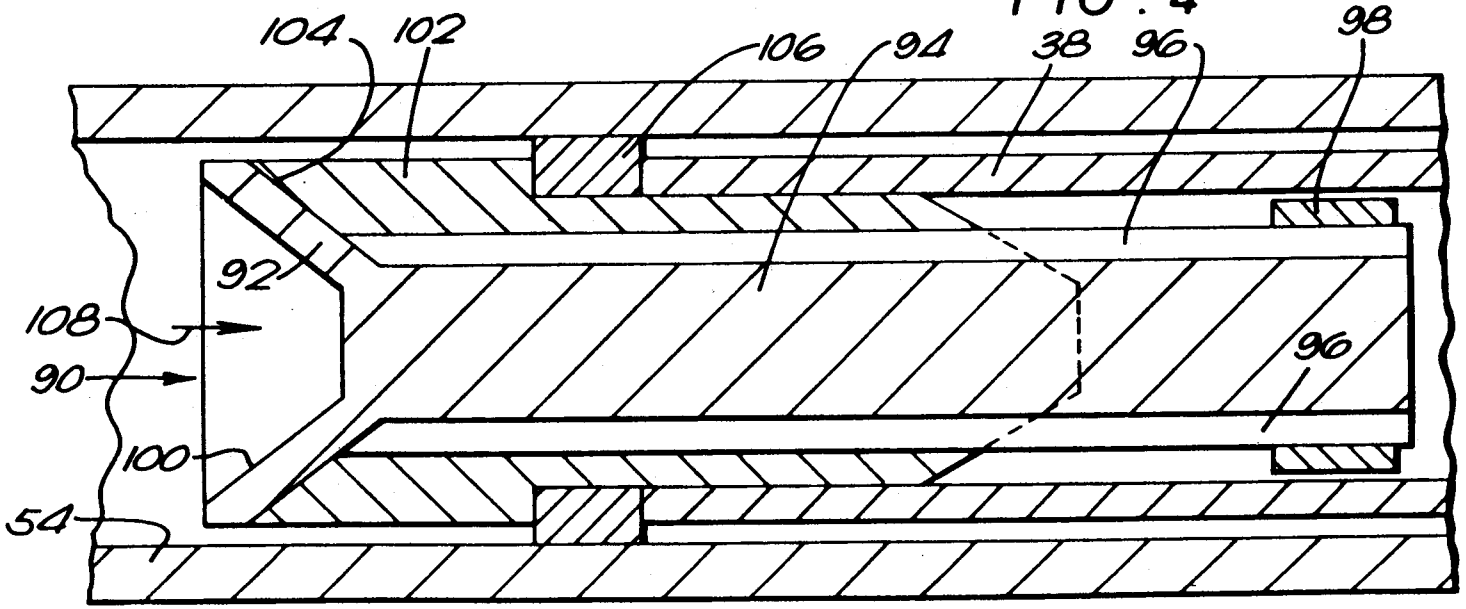
FIG. 4 is an enlarged sectional detail of the inlet valve.

Referring to FIG. 4, this shows in more detail an inlet valve 90 which is positioned within the open end of the sleeve 38. That valve comprises a frusto-conical end 92 and an integrally formed core 94. In the outer surface of the core 94 are provided a number of length-wise extending grooves 96 whilst over the end of the core 94 is fixed a stop sleeve 98. The front end includes a hollowed out frusto-conical depression 100.

The inlet valve 90 is slidably received within an outer sleeve 102. This in turn has at its forward end a frusto-conical shaped seating 104 which mates with the frusto-conical end 92. The outer sleeve 102 is received within the open end of the sleeve 38 and is fixed thereto. Between the outer sleeve 102 and the sleeve 38 is trapped a resilient ring 106, which acts as a sliding seal against the interior of the cylinder 54.

In operation, pressure from water, in the direction of the arrow 108, will urge the inlet valve 90 towards the right in the sense seen in FIG. 4. This will cause the frusto-conical end 92 to seat and seal against the seating 104 and prevents return flow of water in the direction of the arrow 108. By contrast when there is a low pressure on the downstream side of the inlet valve 90, such as when the two units 12 and 14 are moved towards the position shown in FIG. 2 from the position shown in FIG. 1, then water can pass from the interior of the sleeve 38 along the grooves 96 and displace the inlet valve 90 towards the left in the sense seen in FIG. 4, so opening the seal between the frusto-conical end 92 and the seating 104.

To operate the gun, the user first of all fills the reservoir 16 through the inlet 22. Then he grasps the two handles 18 and 50 and, when the units 12 and 14 are moved apart from the position shown in FIG. 1 towards the position shown in FIG. 2, the sleeve 38 will slide along the cylinder 56. As has been described this generates a lower pressure within the cylinder 56 and the inlet valve 90 is displaced towards the left as far as the stop sleeve 98 will allow, but water can then be sucked along the tubing 40 into the sleeve 38 and from there along the grooves 96 into the cylinder 56. When the user then squeezes the two units 12 and 14 together, a high pressure is generated within the water in the cylinder 56 and this causes the inlet valve 90 to seal against the outer sleeve 102. The pressure of water within the cylinder 56 also bears against the ball 70 and displaces this from the end of the bore 60 against the effect of the spring 68, and so water is forced through the bore 60 into the end cap 64. In turn the water is then ejected from the interior of the cap 64 through the nozzle 66 in a conventional manner for toy water guns.

Once the two units 12 and 14 reach the position shown in FIG. 1 then eventually the pressure of water in the cylinder 56 reduces sufficiently for the spring 68 to force the ball 70 to close the bore 60 and then the cycle can be repeated many times until the water in the reservoir 16 is exhausted.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

I claim:

1. In a toy water gun of a type comprising a pump which includes a piston movable along a cylinder and inlet and outlet valves for pumping water from a reservoir and delivering it under pressure to a nozzle, an inlet valve comprising:

a sleeve molded from synthetic plastic material having an upstream end and a downstream end, water from said reservoir being arranged to be in communication with said upstream end, an annular seating having a hollow frusto-conical seat surface at said downstream end; and, a central plunger molded from synthetic plastic material, said plunger comprising a head having an annular sealing surface of a open frusto-conical shape corresponding to the frusto-conical shape of said annular seating capable of engaging said annular seating and tightly sealing thereagainst by the pressure of water pressing the head of said plunger against said annular frusto-conical surface of said sleeve when the pump is activated, an integral shaft slidably received within the sleeve, a stop at the end remote from the head which together with the head retains the shaft in the sleeve, and passage means between the shaft and the sleeve to conduct water past said plunger when said head is not engaged on said seating.

2. A toy water gun according to claim 1 wherein the piston in said pump is hollow and supports said inlet valve, water from said reservoir passing along said hollow interior of said piston and through said valve into said cylinder as said piston is withdrawn along said cylinder.

3. A toy water gun according to claim 1 wherein said outlet valve comprises a spring loaded ball which bears against a seating surrounding a bore.

4. A toy water gun according to claim 1 and further comprising a first hollow handle portion including an integral first handle, that said first portion containing said reservoir and supporting the piston of said pump, and a second hollow portion including an integral second handle and carrying the cylinder of said pump and into which said piston projects, said second handle portion supporting the nozzle, said first and second portions being telescopically mounted relative one another between advanced and retracted positions and movement of the portions between those said positions reciprocating said piston along said cylinder and the resulting pumping action ejecting squirts of water from said nozzle.

5. A toy water gun comprising a water reservoir, a pump for supplying a discrete amount of water under pressure from the reservoir, an outlet nozzle linked to the pump for receiving water from the pump to be emitted as a high speed squirt of water, manually actuated means for operating the pump, a cylinder forming part of said pump, a piston movable along said cylinder, an inlet and an outlet valve for said pump, said piston being hollow and supporting said inlet valve, water from said reservoir passing along said hollow interior of said piston and through said valve into said cylinder as said piston is withdrawn along said cylinder, said inlet valve comprising:

a sleeve molded from synthetic plastic material having an upstream end and a downstream end, water from said reservoir being arranged to be in communication with said upstream end;

an annular seating having a hollow frusto-conical seat surface at said downstream end; and, a central plunger molded from synthetic plastic material, said plunger comprising a head having an annular sealing surface of an open frusto-conical shape corresponding to the frusto-conical shape of said annular seating capable of engaging said annular seating and tightly sealing thereagainst by the pressure of water pressing the plunger against said sleeve when the pump is activated, an integral shaft slidably received within the sleeve, a stop at the end remote from the head which together with the head retains the shaft in the sleeve, and passage means between the shaft and the sleeve to conduct water past said plunger when said head is not engaged on said seating.

6. A toy water gun according to claim 5 and further comprising a first hollow handle portion including an integral first handle, that said first portion containing said reservoir and supporting the piston of said pump, and a second hollow portion including an integral second handle and carrying the cylinder of said pump and into which said piston projects, said second handle portion supporting the nozzle, said first and second portions being telescopically mounted relative one another between advanced and retracted positions and movement of the portions between those said positions reciprocating the piston along the cylinder and the resulting pumping action ejecting squirts of water from said nozzle.

7. A toy water gun of a type comprising a pump for pumping water from a reservoir and delivering it under pressure to a nozzle, said pump comprising:

a) a cylinder mounted within said gun; and, b) a hollow piston slidably mounted within said cylinder, said piston comprising:

(1) a sleeve having an upstream end in communication with said reservoir and a downstream end in communication with said nozzle, said sleeve having therein a hollow seat molded from synthetic plastic and having an annular frusto-conical seat surface diverging in the direction of said downstream end;

(2) a central plunger molded from synthetic plastics slidably mounted in said sleeve, said plunger comprising a head integral with a central shaft, said head having a frusto-conical surface positioned to engage and tightly seal against said seat surface in response to pressure of water developed against said head by movement of the piston in the downstream direction; and, (3) passage means in said sleeve surrounding said shaft to conduct water past said plunger when said head is disengaged from said seat surface in response to flow of water through said sleeve when the piston moves in the upstream direction.

* * * * *